US006543167B1

(12) United States Patent
Dwyer

(10) Patent No.: US 6,543,167 B1
(45) Date of Patent: Apr. 8, 2003

(54) AUXILIARY DISPLAYS

(76) Inventor: Mark Dwyer, 24 Puritan Rd., Reading, MA (US) 01867

( * ) Notice: Subject to any disclaimer, the term of this patent is extended or adjusted under 35 U.S.C. 154(b) by 0 days.

(21) Appl. No.: 09/522,886

(22) Filed: Mar. 10, 2000

(51) Int. Cl.[7] ..... B41J 11/02
(52) U.S. Cl. ..... 40/725; 248/918; 248/442.2
(58) Field of Search ..... 40/725, 735, 790; 248/442.2, 918; D14/439

(56) References Cited

U.S. PATENT DOCUMENTS 2,182,515 A * 12/1939 Chilcote ..... 40/790
5,104,087 A * 4/1992 Wentzloff et al. ..... 248/442.2
5,398,905 A * 3/1995 Hinson ..... 248/442.2
5,549,267 A * 8/1996 Armbruster et al. ..... 248/442.2
5,638,096 A * 6/1997 Schwartz ..... 248/442.2
D380,905 S * 7/1997 Key et al. ..... D6/302
D408,802 S * 4/1999 Hernandez ..... D14/114
5,890,309 A * 4/1999 Markarian ..... 40/733
5,988,582 A * 11/1999 Olivo ..... 248/442.2

FOREIGN PATENT DOCUMENTS

FR 427889 * 8/1911 ..... 40/152 FOR

* cited by examiner

*Primary Examiner*—Cassandra H. Davis
(74) *Attorney, Agent, or Firm*—George E. Kersey

(57) ABSTRACT

An auxiliary display for displaying pictures and other material in connection with electronic display devices. The auxiliary display in made in a frame attachable to an electronic display such as a monitor, wherein the frame includes an outer member having an opening, a backing for the outer member for suspending a photo against the opening. The suspension can be against a trap door, which is closable by rotatable fasteners against the backing.

4 Claims, 3 Drawing Sheets

Fig. 2A
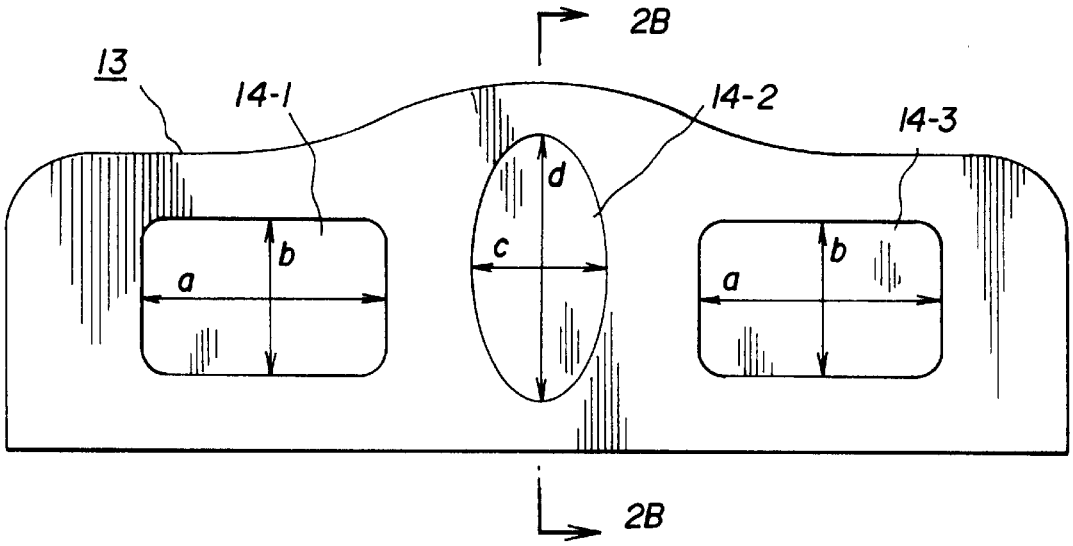
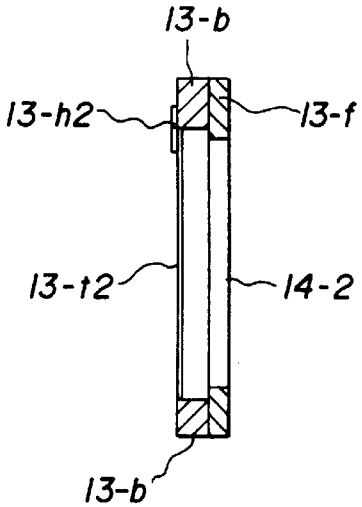
Fig. 2B
Fig. 2C
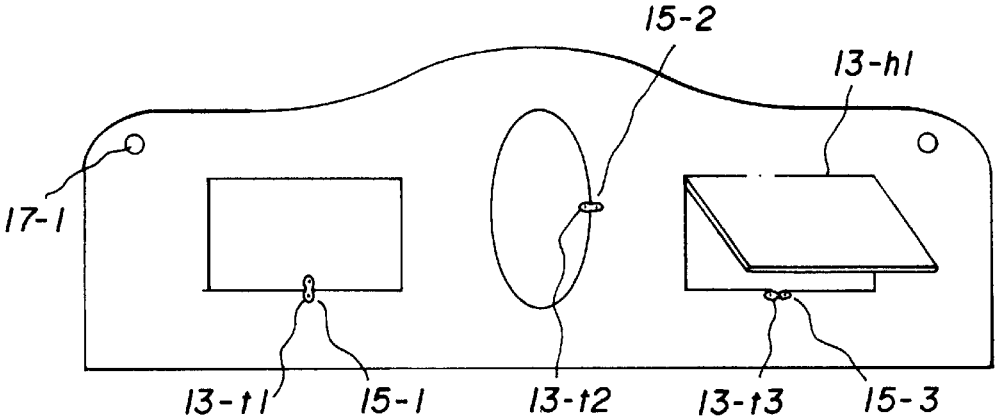

AUXILIARY DISPLAYS

This invention relates to auxiliary displays, and more particularly to the display of pictorial and other material in connection with electronic displays.

Accordingly, it is a principal object of the invention to facilitate the display of pictorial and other material in connection with electronic displays.

Another object of the invention is to provide a display that provides ready access to the display.

A further object of the invention is to provide for display in a fashion that places objects in a decorative arrangement.

SUMMARY OF THE INVENTION accomplishing the foregoing and related objects, the invention provides for auxiliary displays for a primary display by connecting a structure for making a secondary display to the primary display. The primary display can be of electronic information by an electronic monitor, and the secondary display can be of photographic information.

The secondary display desirably is made in a frame attachable to the primary display, with the frame including an outer member having a opening, a backing for the outer member for suspending a photograph against the opening. The suspension can be against a trap door, which is closable by rotatable fasteners against the backing.

The primary display structure can include an outer frame and the frame of the secondary display can be attachable to a portion or the entirety of the outer frame of the primary display.

In a method of the invention for making an auxiliary display the steps can include (a) providing for making a secondary display and (b) connecting the secondary display to a primary display providing electronic information. The secondary display can provide photographic information. The primary display can result from the monitoring of electronic information, with the secondary display be of photographic information.

The secondary display can be made in a frame attachable to the primary display, with the frame including an outer member having a opening and a backing, further including the step of suspending a photograph between the opening and the backing.

In the method the suspension can be against a trap door in the backing, with a trap door closed against the backing.

In another aspect of the method primary structure includes an outer frame and the secondary frame is attached to a portion of, or is made coincident with, the outer frame.

DESCRIPTION OF THE DRAWINGS

Other aspects of the invention will become apparent after considering several illustrative embodiments, taken in conjunction with the drawings, in which:

FIG. 2A is a plan view of the monitor display frame of FIG. 1B.

FIG. 2B is a cross-sectional view of the monitor display frame of FIG. 1 taken along the lines 2B—2B; and FIG. 2C is a back view of the storage frame of FIG. 2A.

DETAILED DESCRIPTION

Figure 1A:
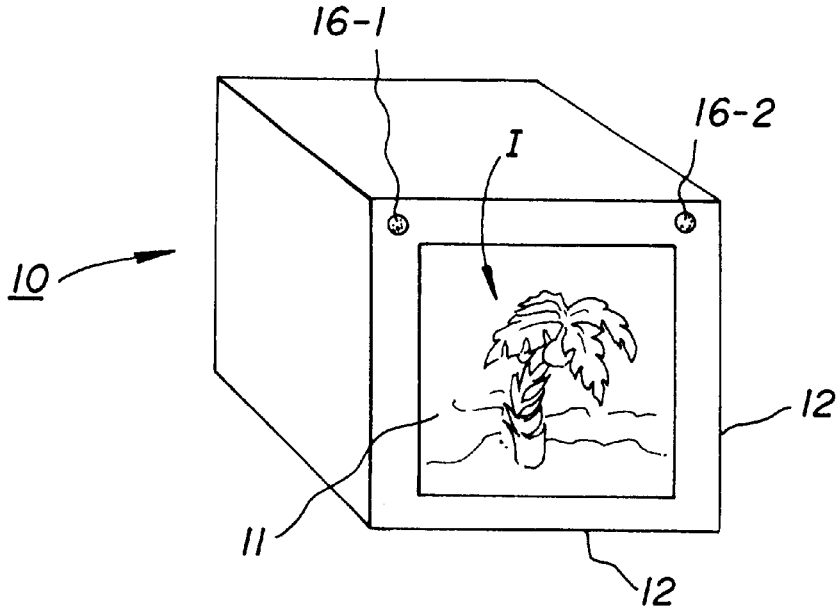
FIG. 1A is a perspective view of a monitor for use in accordance with the invention.

With reference to the drawings, the monitor 10 of FIG. 1A displays electronic information I by sweeping a modulated electronic beam against the interior of a picture tube 11 within a monitor frame 12.

Figure 1B:
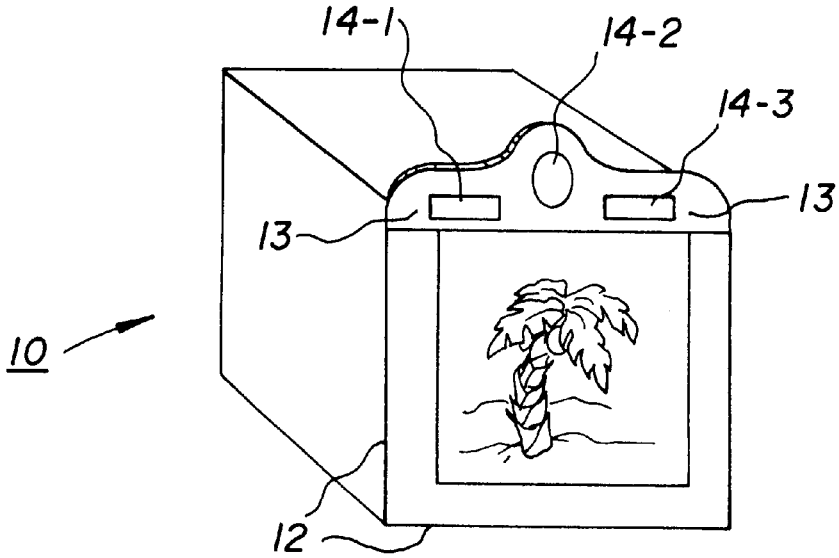
FIG. 1B is a perspective view of a monitor of FIG. 1A with an attached monitor display frame in accordance with the invention.

As shown in FIG. 1B, the invention provides for the attachment of an auxiliary frame 13 which can be used for the display of items, such as photographs, within openings, such as 14-1 through 14-3.

The construction of the overall frame 13 is illustrated in the cross-sectional view of FIG. 2B and the back-side view of FIG. 2C. In FIG. 2B, the frame 13 has a frontal member 13-f and a backing 13-b. The opening 14-2 is formed in the frontal member 13-f, and a trap door 13-t2 is formed in the backing 13-b, as further illustrated in FIG. 2C.

In FIG. 2C additional trap doors 13-t1 and 13-t3 are shown, with the trap door 13-t3 partial open against its hinge 13-h1. All three of the trap doors are closable by rotatable fasteners 15-1 through 15-3, and the backing can be secured to the outer frame 12 by adhesive (not shown) or by fasteners 16-1 and 16-2 of the VELCRO type, where mating hook and mat materials are used, such as those available from Ocean Desert Sales of 5400 Tulip Street, Philadelphia, Pa. 19124.

In a working model of the invention the auxiliary frame 13 had a linear base measuring 17 inches and a curved top having a peak measurement of 6.5 inches tapering to a curved left and right edges measuring 5.5 inches to an upper curve.

Figure 3:
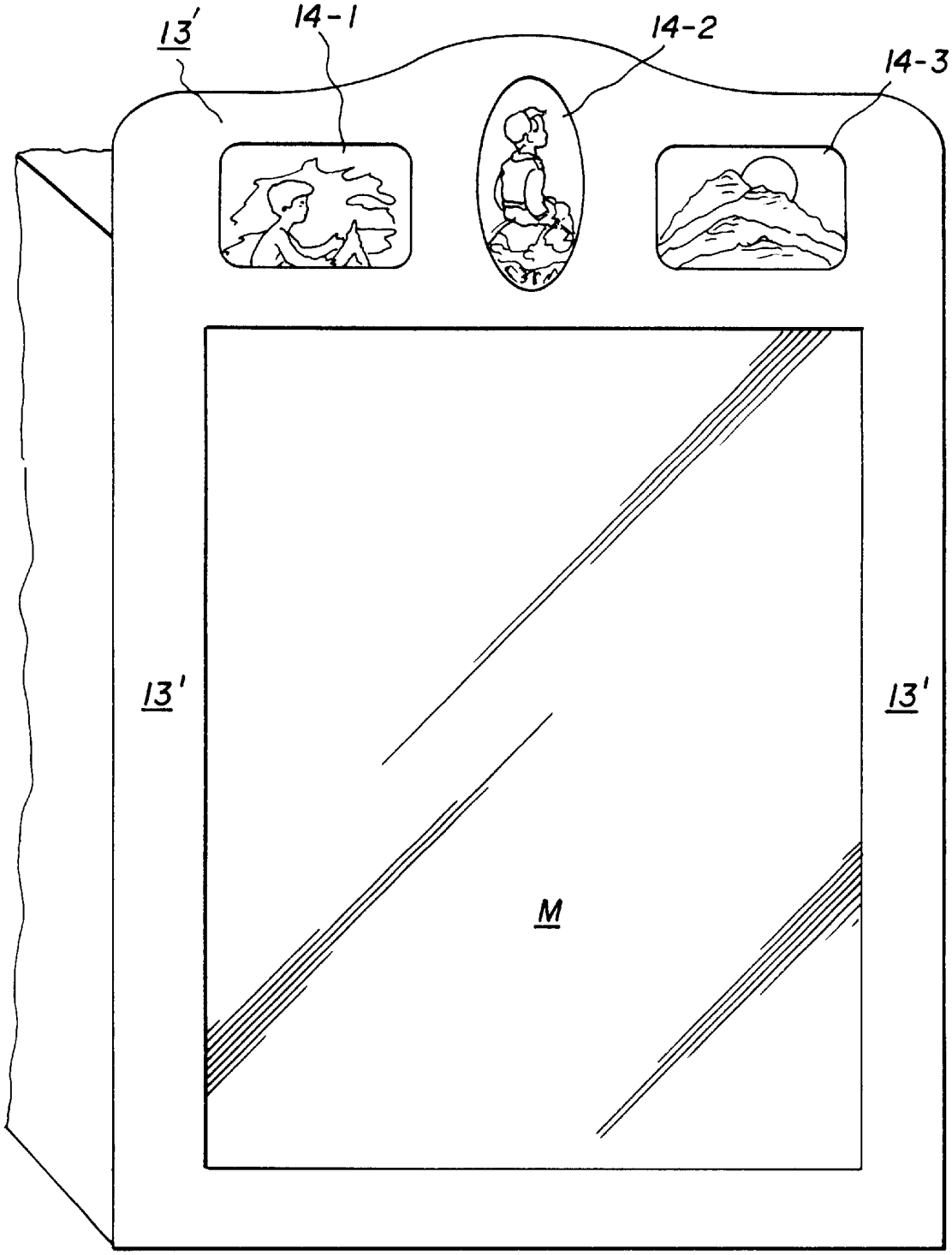
FIG. 3 is a plan view of a full-frame display of the invention adhered to a monitor like that of FIG. 1A.

In the alternative embodiment of FIG. 3 the monitor frame 13' not only extends across the top panel of the monitor screen M, but also extends along both sides and the bottom in order to provide for the secure attachment of the monitor frame 13' completely surrounding the monitor screen M. The top portion with its openings 14-1 through 14-3 has been provided with suitable selected user photographs.

It will be understood that the foregoing detailed description is illustrative only and that other modifications and adaptation will be readily apparent to those of ordinary skill in the art.

What is claimed:

1. Apparatus for making an auxiliary display of pictorial information comprising:

a structure having a front surface and top boarder, said front surface having a first frame surrounding a first display area;

means connectable to the structure for making an alternative display of pictorial information within the display area;

a second frame having means on a rear surface for securing the second frame to the front surface of the first frame;

the second frame having an opening surrounding the first display area and at least one second opening for displaying an auxiliary display; and backing means for securing the auxiliary display against the at least one second opening.

2. Apparatus as defined in claim 1 wherein the structure is an electronic monitor with the first frame surrounding the display area.

3. Apparatus as defined in claim 1 wherein the backing means comprises a trap door.

4. Apparatus as defined in claim 1 further including means for closing the trap door against the backing means.

* * * * *